US010762844B2

(12) United States Patent
Li et al.

(10) Patent No.: US 10,762,844 B2
(45) Date of Patent: Sep. 1, 2020

(54) PIXEL DRIVING CIRCUIT AND METHOD FOR DRIVING THE SAME, DISPLAY PANEL AND COMPENSATION

(71) Applicant: BOE Technology Group Co., Ltd., Beijing (CN)

(72) Inventors: Yongqian Li, Beijing (CN); Pan Xu, Beijing (CN); Quanhu Li, Beijing (CN)

(73) Assignee: BOE TECHNOLOGY GROUP., LTD., Beijing (CN)

( * ) Notice: Subject to any disclaimer, the term of this patent is extended or adjusted under 35 U.S.C. 154(b) by 134 days.

(21) Appl. No.: 16/096,796

(22) PCT Filed: Jan. 17, 2018

(86) PCT No.: PCT/CN2018/073007
§ 371 (c)(1),
(2) Date: Oct. 26, 2018

(87) PCT Pub. No.: WO2018/223702
PCT Pub. Date: Dec. 13, 2018

(65) Prior Publication Data

US 2020/0234644 A1 Jul. 23, 2020

(30) Foreign Application Priority Data

Jun. 9, 2017 (CN) ..... 2017 1 0433108

(51) Int. Cl.
*G09G 5/00* (2006.01)
*G09G 3/3258* (2016.01)

(52) U.S. Cl.
CPC ... *G09G 3/3258* (2013.01); *G09G 2320/0257* (2013.01); *G09G 2330/028* (2013.01)

(58) Field of Classification Search
USPC ..... 345/214, 212, 690, 76, 545, 77, 205; 313/504
See application file for complete search history.

(56) References Cited

U.S. PATENT DOCUMENTS 9,472,158 B2 * 10/2016 Lin ..... G09G 3/3688 345/212
2005/0168491 A1 * 8/2005 Takahara ..... G09G 3/3241 345/690

(Continued)

FOREIGN PATENT DOCUMENTS

CN 101866619 10/2010
CN 101986378 A 3/2011

(Continued)

OTHER PUBLICATIONS

International Search Report and Written Opinion, including English translation of Box V of the Written Opinion, for International Application No. PCT/CN2018/073007, dated Apr. 16, 2018, 9 pages.

(Continued)

*Primary Examiner* — Thuy N Pardo
(74) *Attorney, Agent, or Firm* — Westman, Champlin & Koehler, P.A.

(57) ABSTRACT

The present application provides a pixel driving circuit, including a driving sub-circuit, a compensation sub-circuit, a first switching sub-circuit, and a second switching sub-circuit. The driving sub-circuit has a control terminal electrically connected to a first terminal of the second switching sub-circuit, a first terminal electrically connected to a light-emitting element, and a second terminal electrically connected to a power source; the compensation sub-circuit has a first terminal electrically connected to the first terminal of the driving sub-circuit, and a second terminal electrically connected to the control terminal of the driving sub-circuit; the first switching sub-circuit has a control terminal electrically connected to a first signal input terminal, a first terminal electrically connected to the first terminal of the driving sub-circuit, and a second terminal electrically connected to an initial voltage input terminal; and the second (Continued)

switching sub-circuit has a control terminal electrically connected to a second signal input terminal, a first terminal electrically connected to the control terminal of the driving sub-circuit, and a second terminal electrically connected to a data signal input terminal.

20 Claims, 7 Drawing Sheets

(56) References Cited

U.S. PATENT DOCUMENTS

2008/0169754 A1* 7/2008 Yang ..... G09G 3/3233 313/504
2010/0277401 A1* 11/2010 Takahara ..... H01L 27/3244 345/76
2010/0295861 A1* 11/2010 Somerville ..... G09G 3/3216 345/545
2013/0063498 A1* 3/2013 Yabukane ..... G09G 3/3225 345/690
2013/0127692 A1 5/2013 Yoon et al.
2014/0104262 A1* 4/2014 Miyake ..... G09G 3/3696 345/212
2015/0213761 A1* 7/2015 Chen ..... G09G 3/3291 345/77
2015/0310807 A1* 10/2015 Sun ..... G09G 3/3258 345/205
2016/0125811 A1 5/2016 Park et al.
2016/0247449 A1* 8/2016 Yin ..... G09G 3/3233 345/214
2016/0351122 A1* 12/2016 Jung ..... G09G 3/2085 345/212
2017/0110055 A1 4/2017 Li et al.
2017/0373889 A1* 12/2017 Sakai ..... H03K 3/356173 345/214

FOREIGN PATENT DOCUMENTS

CN 102222468 A 10/2011
CN 103123774 A 5/2013
CN 104751804 A 7/2015
CN 105575332 A 5/2016
CN 106991969 A 7/2017
KR 10-1577907 B1 12/2015

OTHER PUBLICATIONS

"Simple Pixel Circuits for High Resolution and High Image Quality Organic Light Emitting Diode-on-Silicon Microdisplays with Wide Data Voltage Range", by S. Hong et al., Journal of the SID, 2016, pp. 110-116.

* cited by examiner $$Vgs=(1-a)(Vdata-Vref)+Vth-\triangle V$$

PIXEL DRIVING CIRCUIT AND METHOD FOR DRIVING THE SAME, DISPLAY PANEL AND COMPENSATION

CROSS-REFERENCE TO RELATED APPLICATION(S)

This application is a Section 371 National Stage Application of International Application No. PCT/CN2018/073007, filed on Jan. 17, 2018, which has not yet published, and claims priority to Chinese Patent Application No. 201710433108.3, filed on Jun. 9, 2017, the contents of which are incorporated herein by reference in their entirety.

TECHNICAL FIELD

The present disclosure relates to the field of display control technologies, and more particularly, to a pixel driving circuit and a method for driving the same, a display panel, and a pixel compensation method.

BACKGROUND

Currently, Organic Light-Emitting Diode (OLED) pixel driving circuits using two or three switching transistors mostly adopt a driving mode using a variable power supply. Although some driving circuits may not adopt such a driving mode, it needs to increase a number of capacitors, which may undoubtedly bring great difficulties to design of a large number of pixels. Further, some driving circuits comprise a grounding design of switching transistors, and it is difficult to implement an effective pixel compensation technique in these driving circuits.

Therefore, the current OLED pixel driving circuit needs to be improved.

SUMMARY

In embodiments according to a first aspect of the present disclosure, there is proposed a pixel driving circuit. The pixel driving circuit comprises a driving sub-circuit, a compensation sub-circuit, a first switching sub-circuit, and a second switching sub-circuit. The driving sub-circuit has a control terminal electrically connected to a first terminal of the second switching sub-circuit, a first terminal electrically connected to a light-emitting element, and a second terminal electrically connected to a power source; the compensation sub-circuit has a first terminal electrically connected to the first terminal of the driving sub-circuit, and a second terminal electrically connected to the control terminal of the driving sub-circuit; the first switching sub-circuit has a control terminal electrically connected to a first signal input terminal, a first terminal electrically connected to the first terminal of the driving sub-circuit, and a second terminal electrically connected to an initial voltage input terminal; and the second switching sub-circuit has a control terminal electrically connected to a second signal input terminal, a first terminal electrically connected to the control terminal of the driving sub-circuit, and a second terminal electrically connected to a data signal input terminal.

According to the pixel driving circuit according to the embodiments of the present disclosure, with a circuit structure having two switching sub-circuits and one compensation sub-circuit in combination with related control strategies, current of a pixel in a light-emitting phase is not affected by a threshold voltage Vth, and thus a change in Vth may be compensated.

In one embodiment, in a resetting phase, the first switching sub-circuit is configured to be in a turn-on state under control of the first signal input terminal, and the second switching sub-circuit is configured to be in a turn-on state within a preset time under control of the second signal input terminal; and in a compensation phase, the first switching sub-circuit is configured to be in a turn-off state under control of the first signal input terminal, and the second switching sub-circuit is configured to be in a turn-on state within the preset time under control of the second signal input terminal.

In one embodiment, in a data writing phase, the first switching sub-circuit is configured to be in a turn-off state under control of the first signal input terminal, and the second switching sub-circuit is configured to be in a turn-on state under control of the second signal input terminal; and in a light-emitting phase, the first switching sub-circuit is configured to be in a turn-off state under control of the first signal input terminal, and the second switching sub-circuit is configured to be in a turn-off state under control of the second signal input terminal.

In one embodiment, a duration of the resetting phase is less than that of the compensation phase, and a duration of the data writing phase is less than that of the resetting phase.

In one embodiment, the second switching sub-circuit is configured to receive a compensated data voltage from the data signal input terminal, wherein the compensated data voltage is determined based on a threshold voltage and a mobility of the driving sub-circuit.

In one embodiment, the driving sub-circuit comprises a driving transistor, the compensation sub-circuit comprises a compensation capacitor, the first switching sub-circuit comprises a first switching transistor, and the second switching sub-circuit comprises a second switching transistor.

In embodiments according to a second aspect of the present disclosure, there is proposed a display panel. The display panel comprises the pixel driving circuit according to the embodiments of the first aspect of the present disclosure.

In one embodiment, the display panel further comprises: a controller configured to: detect, through the first switching sub-circuit, a current threshold voltage and a current mobility of the driving sub-circuit; generate a threshold compensation voltage and a first mobility compensation voltage according to the current threshold voltage and the current mobility of the driving sub-circuit; generate a total compensation voltage according to the threshold compensation voltage and the first mobility compensation voltage when the threshold compensation voltage is greater than a first preset threshold; and compensate for a data voltage input to the pixel driving circuit according to the total compensation voltage.

In one embodiment, the controller is further configured to: when the mobility of the driving sub-circuit changes, generate a second mobility compensation voltage according to the current threshold voltage and the changed mobility, and update the total compensation voltage according to the second mobility compensation voltage when a voltage difference between the first mobility compensation voltage and the second mobility compensation voltage is greater than a second preset threshold.

In one embodiment, the controller is further configured to: acquire a power-off threshold voltage and a power-off mobility of the driving sub-circuit when a pixel is powered off to stop emitting light, and store the power-off threshold voltage and the power-off mobility through a memory, so that the power-off threshold voltage and the power-off mobility stored in the memory are used as an initial threshold voltage and an initial mobility respectively after the pixel is powered on again.

In embodiments according to a third aspect of the present disclosure, there is proposed a method for driving the pixel driving circuit according to the first aspect of the present disclosure. The method comprises: in a resetting phase, controlling the first switching sub-circuit to be turned on, and controlling the second switching sub-circuit to be turned on for a preset time; and in a compensation phase, controlling the first switching sub-circuit to be turned off, and controlling the second switching sub-circuit to be turned on for the preset time.

In one embodiment, the method further comprises: in a data writing phase, controlling the first switching sub-circuit to be turned off, and controlling the second switching sub-circuit to be turned on; and in a light-emitting phase, controlling the first switching sub-circuit and the second switching sub-circuit to be turned off.

In one embodiment, a duration of the resetting phase is less than that of the compensation phase, and a duration of the data writing phase is less than that of the resetting phase.

In embodiments according to a fourth aspect of the present disclosure, there is proposed a pixel compensation method by the display panel according to the second aspect of the present disclosure. The method comprises: detecting a current threshold voltage and a current mobility of the driving sub-circuit; generating a threshold compensation voltage and a first mobility compensation voltage according to the current threshold voltage and the current mobility of the driving sub-circuit; and when the threshold compensation voltage is greater than a first preset threshold, generating a total compensation voltage according to the threshold compensation voltage and the first mobility compensation voltage; and compensating for a data voltage input at the data signal input terminal according to the total compensation voltage.

In one embodiment, the method further comprises: when the mobility of the driving sub-circuit changes, generating a second mobility compensation voltage according to the current threshold voltage and the changed mobility; determining whether a voltage difference between the first mobility compensation voltage and the second mobility compensation voltage is greater than a second preset threshold; and if the voltage difference is greater than the second preset threshold, updating the total compensation voltage according to the second mobility compensation voltage.

In one embodiment, the method further comprises: acquiring a power-off threshold voltage and a power-off mobility of the driving sub-circuit when the pixel is powered off to stop emitting light, and storing the power-off threshold voltage and the power-off mobility, so that the stored power-off threshold voltage and power-off mobility are used as an initial threshold voltage and an initial mobility respectively after the pixel is powered on again.

DETAILED DESCRIPTION

The embodiments of the present disclosure will be described in detail below, and examples of the embodiments are illustrated in the accompanying drawings, throughout which the same or similar reference signs are used to refer to the same or similar elements or elements having the same or similar functions. The embodiments described below with reference to the accompanying drawings are illustrative and intended to explain the present disclosure, and are not to be construed as limiting the present disclosure.

A pixel driving circuit and a method for driving the same, a display panel, and a pixel compensation method according to the embodiments of the present disclosure will be described below with reference to the accompanying drawings.

It should be illustrated that pixels according to the embodiments of the present disclosure may be OLED pixels or Quantum Dot Light Emitting Diodes (QLED) pixels, etc., and the OLED pixels are taken as an example for description below.

Figure 1A:
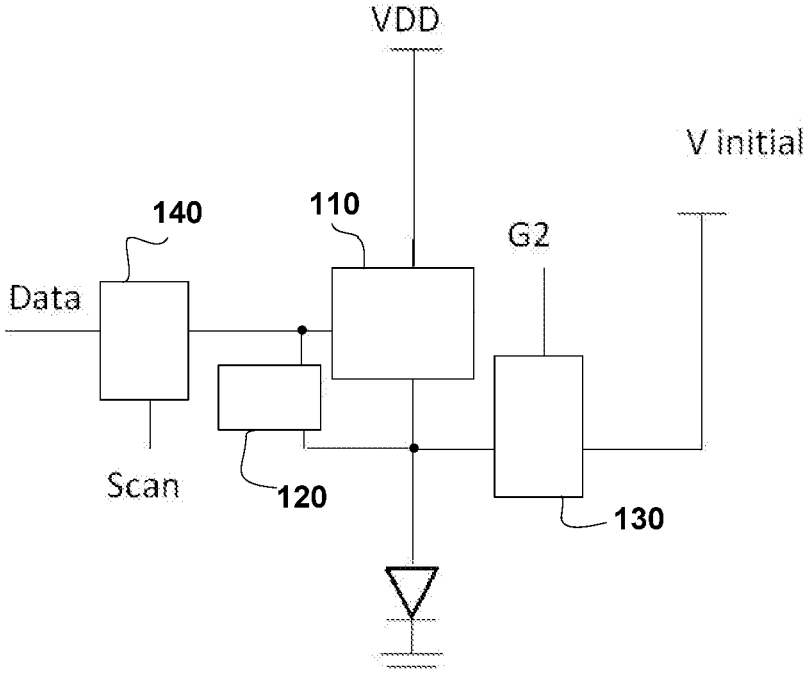
FIG. 1A is a diagram of a pixel driving circuit according to an embodiment of the present disclosure.

As shown in FIG. 1A, the pixel driving circuit according to the embodiments of the present disclosure comprises a driving sub-circuit 110, a compensation sub-circuit 120, a first switching sub-circuit 130, and a second switching sub-circuit 140.

Specifically, the driving sub-circuit 110 has a control terminal electrically connected to a first terminal of the second switching sub-circuit 140, a first terminal electrically connected to a light-emitting element, and a second terminal electrically connected to a power source VDD. The light-emitting element may be an OLED or QLED unit etc. Hereinafter, an OLED is taken as an example of the light-emitting element.

The compensation sub-circuit 120 has a first terminal electrically connected to the first terminal of the driving sub-circuit 110, and a second terminal electrically connected to the control terminal of the driving sub-circuit 110.

The first switching sub-circuit 130 has a control terminal electrically connected to a first signal input terminal G2, a first terminal electrically connected to the first terminal of the driving sub-circuit 110, and a second terminal electrically connected to an initial voltage input terminal Vinitial.

The second switching sub-circuit 140 has a control terminal electrically connected to a second signal input terminal Scan, a first terminal electrically connected to the control terminal of the driving sub-circuit 110, and a second terminal electrically connected to a data signal input terminal Data.

Figure 1B:
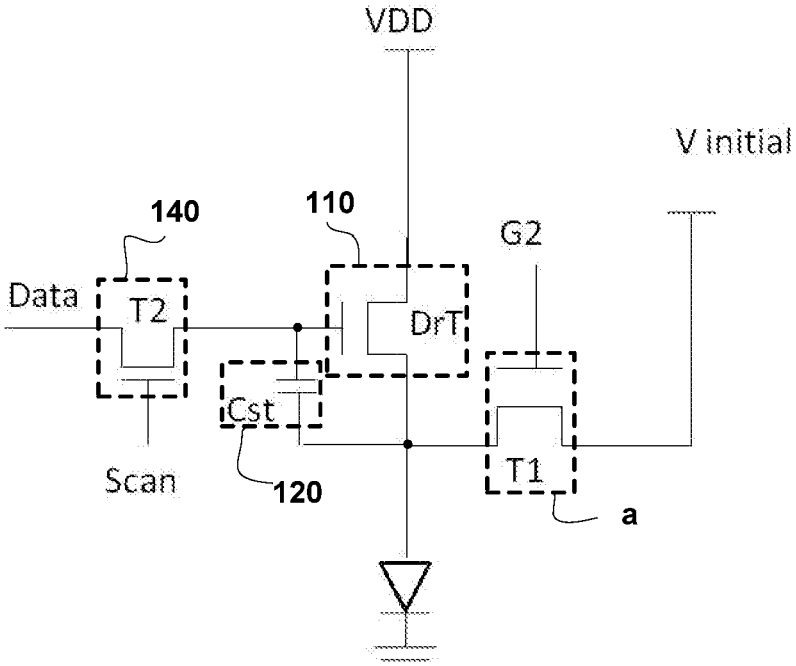
FIG. 1B is a detailed diagram of a pixel driving circuit according to an embodiment of the present disclosure.

As shown in FIG. 1B, in one embodiment, the driving sub-circuit 110 may comprise a driving transistor DrT, the compensation sub-circuit 120 may comprise a compensation capacitor Cst, the first switching sub-circuit 130 may comprise a first switching transistor T1, and the second switching sub-circuit 140 may comprise a second switching transistor T2. In the following detailed description of the present disclosure, the embodiment shown in FIG. 1B is used as an example for description. It is to be understood that this embodiment is only exemplary and does not limit the scope of the present disclosure.

Specifically, in the driving sub-circuit 110, the driving transistor DrT has a gate, a source and a drain, wherein the gate corresponds to a control terminal of the driving transistor DrT, the source corresponds to one of the first terminal and the second terminal of the driving transistor DrT, and the drain corresponds to the other of the first terminal and the second terminal of the driving transistor DrT (hereinafter, description is made by taking the control terminal, the first terminal and the second terminal of the driving transistor DrT as an example), wherein the second terminal of the driving transistor DrT is electrically connected to the power source to input a power voltage VDD through the second terminal of the driving transistor DrT, and the first terminal of the driving transistor DrT is electrically connected to an anode of the OLED to provide driving current to the OLED.

The compensation capacitor Cst has a first terminal electrically connected to the first terminal of the driving transistor DrT, and a second terminal electrically connected to the control terminal of the driving transistor DrT, and the compensation capacitor Cst may be configured to store a voltage between the control terminal and the first terminal of the driving transistor DrT.

The first switching transistor T1 has a gate, a source and a drain, wherein the gate corresponds to the control terminal of the first switching transistor T1, the source corresponds to one of the first terminal and the second terminal of the first switching transistor T1, and the drain corresponds to the other of the first terminal and the second terminal of the first switching transistor T1 (hereinafter, description is made by taking the control terminal, the first terminal and the second terminal of the first switching transistor T1 as an example.) The first switching transistor T1 has a first terminal electrically connected to the first terminal of the driving transistor DrT, and a second terminal electrically connected to the initial voltage input terminal, and an initial voltage input at the initial voltage input terminal is Vinitial.

The second switching transistor T2 has a gate, a source and a drain, wherein the gate corresponds to the control terminal of the second switching transistor T2, the source corresponds to one of the first terminal and the second terminal of the second switching transistor T2, and the drain corresponds to the other of the first terminal and the second terminal of the second switching transistor T2 (hereinafter, description is made by taking the control terminal, the first terminal and the second terminal of the second switching transistor T2 as example.) The second switching transistor T2 has a first terminal electrically connected to the control terminal of the driving transistor DrT, and a second terminal electrically connected to the data signal input terminal Data, and a data voltage Vdata and a reference voltage Vref may be input through the data signal input terminal Data.

The control terminal of the first switching transistor T1 is electrically connected to the first signal input terminal to receive a first control signal G2 input at the first signal input terminal. The control terminal of the second switching transistor T2 is electrically connected to the second signal input terminal to receive a second control signal Scan input at the second signal input terminal.

It should be illustrated that the driving transistor DrT, the first switching transistor T1 and the second switching transistor T2 may all be Thin Film Transistors (TFTs), wherein each of the control terminal of the driving transistor DrT, the control terminal of the first switching transistor T1 and the control terminal of the second switching transistor T2 corresponds to a gate of a corresponding TFT, each of the first terminal of the driving transistor DrT, the first terminal of the first switching transistor T1 and the first terminal of the second switching transistor T2 may correspond to one of a source and a drain of the corresponding TFT, and each of the second terminal of the driving transistor DrT, the second terminal of the first switching transistor T1, and the second terminal of the second switching transistor T2 may correspond to the other of the source and the drain. In an example described below, the first terminal of the driving transistor DrT may correspond to the source of the TFT.

In one embodiment of the present disclosure, compensation for a threshold voltage of the driving transistor DrT may be realized in the pixel driving circuit described above. Specifically, in a resetting phase, the first signal input terminal controls the first switching transistor T1 to be turned on, and the second signal input terminal controls the second switching transistor T2 to be turned on for a preset time; in a compensation phase, the first signal input terminal controls the first switching transistor T1 to be turned off, the second signal input terminal controls the second switching transistor T2 to be turned on for a preset time; in a data writing phase, the first signal input terminal controls the first switching transistor T1 to be turned off, and the second signal input terminal controls the second switching transistor T2 to be turned on; and in a light-emitting phase, the first signal input terminal controls the first switching transistor T1 to be turned off, and the second signal input terminal controls the second switching transistor T2 to be turned off.

Figure 2:
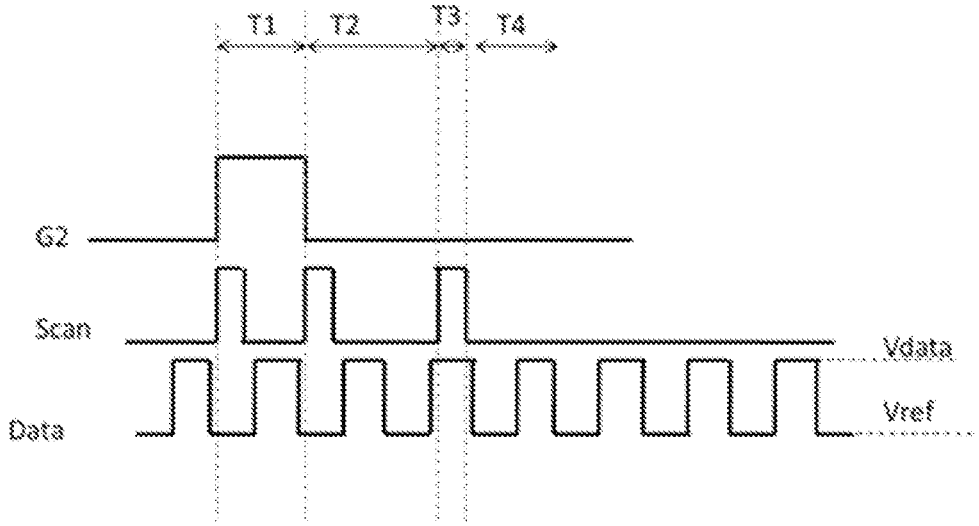
FIG. 2 is a timing diagram of input signals of a pixel driving circuit according to an embodiment of the present disclosure.

As shown in FIG. 2, the resetting phase may correspond to a first time period t1, the compensation phase may correspond to a second time period t2, the data writing phase may correspond to a third time period t3, and the light-emitting phase may correspond to a fourth time period t4. Here, the first time period may be less than the second time period, and the third time period may be less than the first time period, that is, the resetting phase may have duration less than that of the compensation phase and greater than that of the data writing phase.

Figure 3:
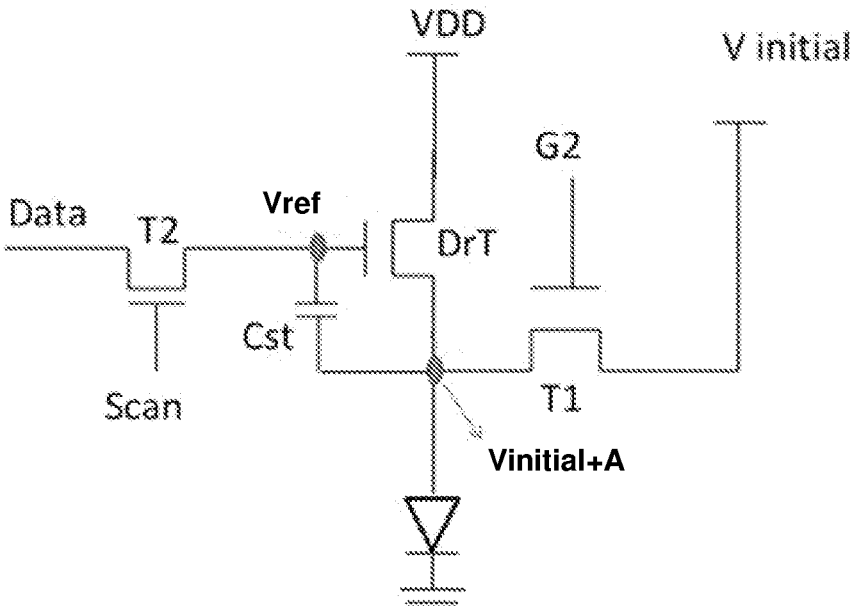
FIG. 3 is a diagram illustrating a state of a pixel driving circuit in a resetting phase according to an embodiment of the present disclosure.

As shown in FIGS. 2 and 3, in the resetting phase, that is, during the time period t1, the first control signal G2 is at a high level, and the second control signal Scan may be maintained at a high level within a preset time and may be maintained at a low level during other time periods, so that the first switching transistor T1 may be controlled to be continuously turned on, and the second switching transistor T2 may be controlled to be turned on for the preset time. Further, within the preset time, the reference voltage Vref is input at the data signal input terminal Data, so that a voltage at the control terminal of the driving transistor DrT may be controlled to be Vref, and a voltage at the first terminal of the driving transistor DrT may be controlled to be Vinitial+A, where A is a voltage drop generated due to current existing between the power supply terminal and the initial voltage input terminal.

Figure 4:
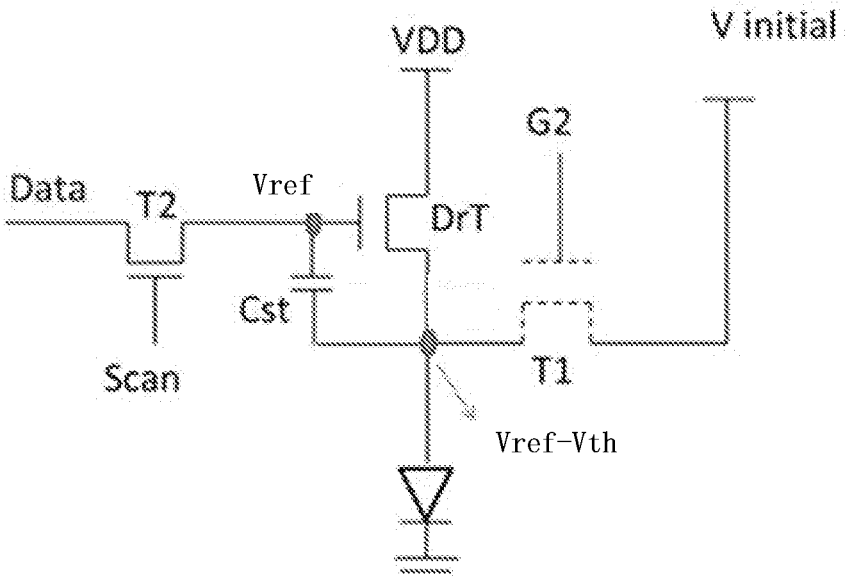
FIG. 4 is a diagram illustrating a state of a pixel driving circuit in a compensation phase according to an embodiment of the present disclosure.

As shown in FIGS. 2 and 4, in the compensation phase, that is, during the time period t2, the first control signal G2 is at a low level, and the second control signal Scan may be maintained at a high level within a preset time and may be maintained at a low level during other time periods, so that the first switching transistor T1 may be controlled to be turned off, and the second switching transistor T2 may be controlled to be turned on for the preset time. Here, the switching transistor indicated by broken lines in FIG. 4 is in a turn-off state, which applies below. Thereby, the voltage at the control terminal of the driving transistor DrT may be controlled to be Vref, and the voltage at the first terminal of the driving transistor DrT may be controlled to be Vref-Vth, where Vth is the threshold voltage of the driving transistor DrT. That is, a voltage difference across the compensation capacitor Cst is Vth, so that the threshold voltage Vth may be stored by the compensation capacitor Cst.

Figure 5:
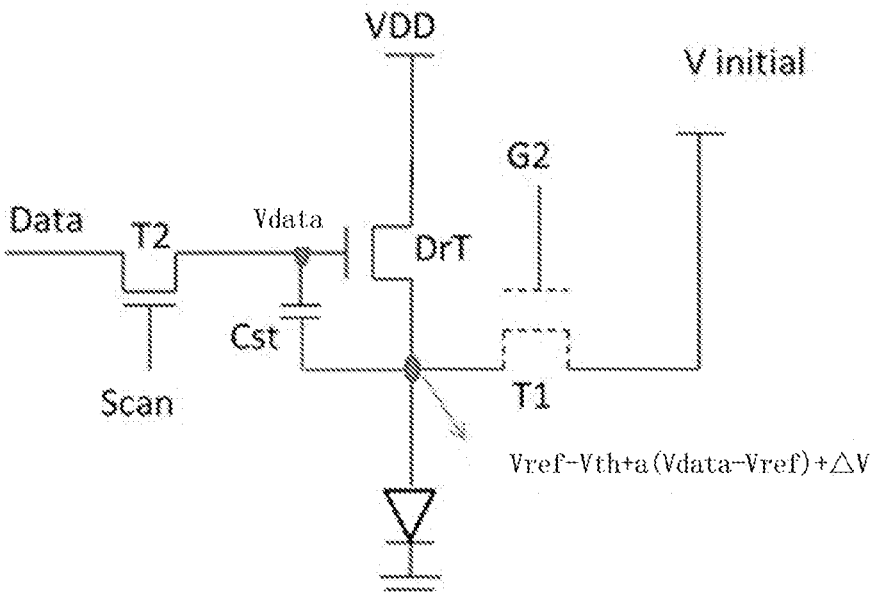
FIG. 5 is a diagram illustrating a state of a pixel driving circuit in a data writing phase according to an embodiment of the present disclosure.

As shown in FIGS. 2 and 5, in the data writing phase, that is, during the time period t3, the first control signal G2 is at a low level, the second control signal Scan is at a high level, and a data voltage Vdata is input at the data signal input terminal Data, so that the first switching transistor T1 may be controlled to be turned off, and the second switching transistor T2 may be controlled to be turned on. Thereby, the voltage at the control terminal of the driving transistor DrT may be controlled to be Vdata, and the voltage at the first terminal of the driving transistor DrT may be controlled to be $Vref-Vth+a(Vdata-Vref)+\Delta V$, where $\Delta V$ is a voltage difference generated by electric leakage of the driving transistor DrT in the data writing phase, and a is a ratio of voltages allocated to opposite terminals of the compensation capacitor Cst due to a capacitive voltage division effect in the data writing phase.

Figure 6:
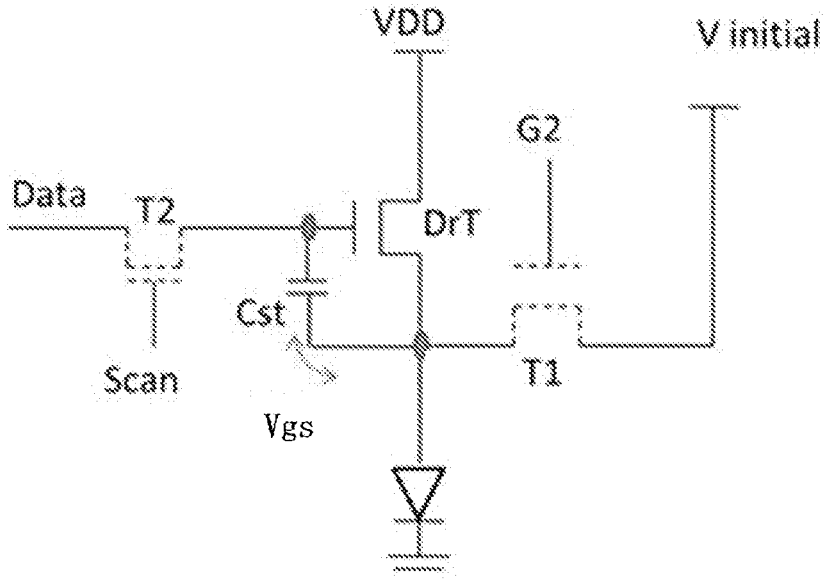
FIG. 6 is a diagram illustrating a state of a pixel driving circuit in a light-emitting phase according to an embodiment of the present disclosure.

As shown in FIGS. 2 and 6, in the light-emitting phase, that is, during the time period t4, the first control signal G2 is at a low level, and the second control signal Scan is at a low level, so that the first switching transistor T1 and the second switching transistor T2 may both be controlled to be turned off. Thereby, the voltage $Vgs=(1-a)(Vdata-Vref)+Vth-\Delta V$ between the control terminal and the first terminal of the driving transistor DrT may be controlled. Current flowing through the OLED is $Ioled=\frac{1}{2}\times Ku(Vgs-Vth)^2=\frac{1}{2}\times Ku((1-a)(Vdata-Vref)-\Delta V)^2$, where Ku is a parameter related to a mobility of the driving transistor DrT. That is, Ioled is related to parameters such as Ku, Vdata, Vref, and $\Delta V$ etc., and is independent of the threshold voltage Vth of the driving transistor DrT.

In one embodiment, the second switching transistor T2 may further be configured to receive a compensated data voltage from the data signal input terminal Data. Here, the compensated data voltage is determined based on the threshold voltage and the mobility of the driving transistor DrT. This corresponds to external compensation which will be described below.

According to the pixel driving circuit according to the embodiments of the present disclosure, with the above-mentioned circuit structure using the two switching transistors T1, T2 and one compensation capacitor Cst in combination with control strategies for T1 and T2, current of a pixel in the light-emitting phase is not affected by the threshold voltage Vth of the driving transistor DrT, and thus a change in Vth may be compensated. This pixel driving circuit not only has a simple circuit structure, but also has high real-time performance for the threshold voltage compensation, which can effectively improve the problem of display of residual images on the display panel and greatly improve the display effect of the display panel.

In correspondence with the above embodiments, the present disclosure further proposes a display panel.

Figure 7:
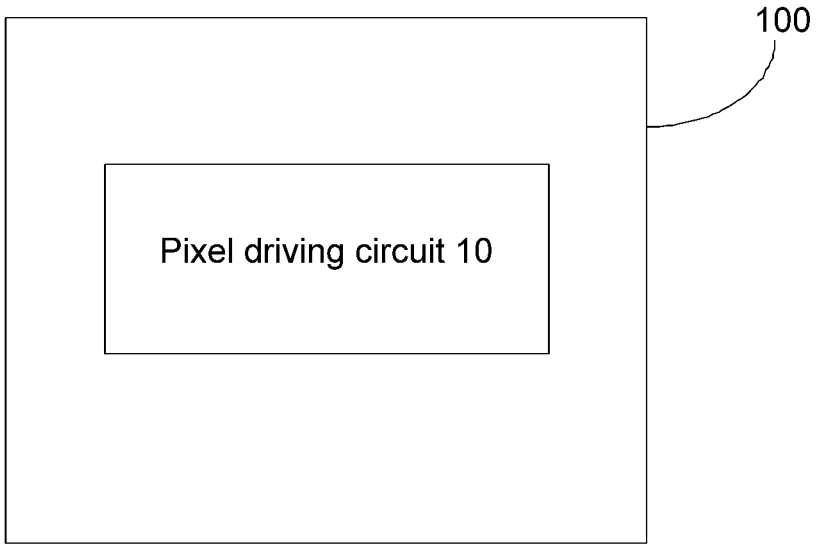
FIG. 7 is a block diagram of a display panel according to an embodiment of the present disclosure.

As shown in FIG. 7, a display panel 100 according to an embodiment of the present disclosure comprises the pixel driving circuit 10 described above.

According to the display panel according to the embodiment of the present disclosure, with the pixel driving circuit described above, the problem of displaying residual images can be effectively improved, and a good display effect is realized.

In addition, external compensation may further be implemented on the basis of the pixel driving circuit according to the embodiment of the present disclosure, that is, the data voltage received by the pixel driving circuit is compensated to further improve the compensation accuracy. Specifically, this may be exemplarily implemented by providing a controller in the display panel 100.

Specifically, the controller may be electrically connected to the pixel driving circuit according to the embodiment of the present disclosure which is included in the display panel, for example, to the first switching transistor T1 and the second switching transistor T2 of the pixel driving circuit. The controller may detect a current threshold voltage Vth and a current mobility Mob of the driving transistor DrT (through, for example, the first switching transistor T1), and generate a threshold compensation voltage $\Delta Vth$ and a first mobility compensation voltage $\Delta Vmob$ according to the current threshold voltage Vth and the current mobility Mob of the driving transistor DrT.

Here, when the threshold compensation voltage $\Delta Vth$ is greater than a first preset threshold, the controller may generate a total compensation voltage according to the threshold compensation voltage $\Delta Vth$ and the first mobility compensation voltage $\Delta Vmob$, and compensate for the data voltage Vdata input at the data signal input terminal according to the total compensation voltage. In one embodiment of the present disclosure, when the threshold compensation voltage $\Delta Vth$ is greater than 0.5V, it is difficult to eliminate the influence of Vth on the current Ioled flowing through the OLED, and at this time, $k\Delta Vth$ may be added to the data voltage in the light-emitting phase, that is, the data voltage is $Vdata+k\Delta Vth+\Delta Vmob$, where k is a compensation coefficient, which may be acquired through subsequent tests, and has a value ranging from 0 to 1.

Since the mobility of the driving transistor DrT is greatly affected by the temperature, when the mobility of the driving transistor DrT changes, for example, at a data black time, i.e., the time when the data is not written in each frame, the mobility compensation voltage may be acquired again to update the total compensation voltage. Specifically, when the mobility of the driving transistor DrT changes, the controller may generate a second mobility compensation voltage $\Delta Vmob_new$ according to the current threshold voltage and the changed mobility, and the controller may compensate for the total compensation voltage according to the second mobility compensation voltage $\Delta Vmob_new$ when a voltage difference between the first mobility compensation voltage $\Delta Vmob$ and the second mobility compensation voltage $\Delta Vmob_new$ is greater than a second preset threshold. That is, if the mobility compensation voltage changes greatly, the data voltage may be compensated using the mobility compensation voltage which is newly obtained. In one embodiment of the present disclosure, after mobilities of all rows of driving transistors DrT are acquired, the data voltage may be Vdata+kΔVth+ΔVmob_new in a light-emitting phase of a next frame.

When the pixel is powered off to stop emitting light, for example, when the OLED display panel stops emitting light due to shutdown, the controller may obtain a power-off threshold voltage and a power-off mobility of the driving transistor DrT, and store the power-off threshold voltage and the power-off mobility through a memory, so as to use the power-off threshold voltage and the power-off mobility stored in the memory as an initial threshold voltage and an initial mobility respectively after the pixel is powered on again. Thereby, a strategy of compensating for the data voltage may be performed again according to the initial threshold voltage and the initial mobility when the display panel displays the next time.

In summary, the external compensation is combined with the internal compensation in the pixel driving circuit to achieve hybrid compensation, which can effectively improve the compensation accuracy, thereby further enhancing the display effect of the display panel.

In correspondence with the above embodiments, the present disclosure further proposes a method for driving the pixel driving circuit described above.

Here, as shown in FIG. 1B, the pixel driving circuit comprises a driving transistor DrT having a first terminal and a second terminal which is electrically connected to a power source, a compensation capacitor Cst having a first terminal electrically connected to the first terminal of the driving transistor DrT and a second terminal electrically connected to a control terminal of the driving transistor DrT, a first switching transistor T1 having a first terminal electrically connected to the first terminal of the driving transistor DrT and a second terminal electrically connected to an initial voltage input terminal, and a second switching transistor T2 having a first terminal electrically connected to the control terminal of the driving transistor DrT and a second terminal electrically connected to the data signal input terminal.

Figure 8:
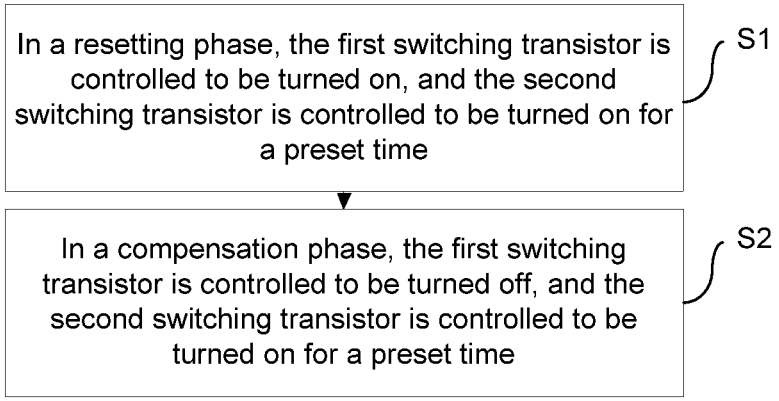
FIG. 8 is a flowchart of a method for driving the pixel driving circuit according to an embodiment of the present disclosure.

As shown in FIG. 8, the method may comprise the following steps.

In S1, in a resetting phase, the first switching transistor is controlled to be turned on, and the second switching transistor is controlled to be turned on for a preset time.

In the embodiment of the present disclosure, as shown in FIG. 1B, the control terminal of the first switching transistor T1 may input a first control signal G2, the control terminal of the second switching transistor T2 may input a second control signal Scan, and turn-on and turn-off of the first switching transistor and the second switching transistor may be controlled by changing levels of the first control signal G2 and the second control signal Scan.

In S2, in a compensation phase, the first switching transistor is controlled to be turned off, and the second switching transistor is controlled to be turned on for a preset time.

Figure 9:
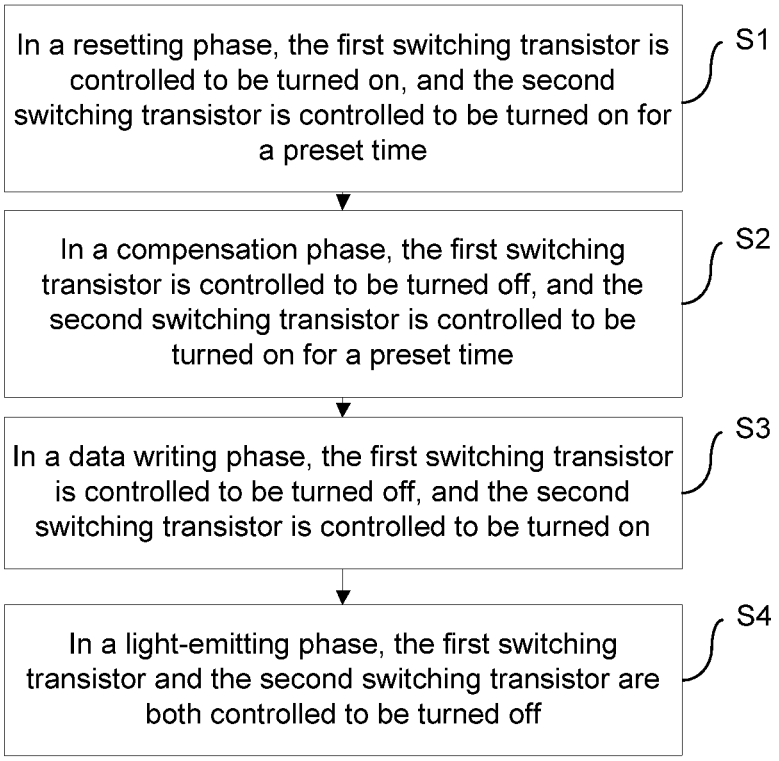
FIG. 9 is a flowchart of a method for driving the pixel driving circuit according to another embodiment of the present disclosure.

As shown in FIG. 9, the method may further comprise the following steps.

In S3, in a data writing phase, the first switching transistor is controlled to be turned off, and the second switching transistor is controlled to be turned on.

In S4, in a light-emitting phase, the first switching transistor and the second switching transistor are both controlled to be turned off.

Here, as shown in FIG. 2, the resetting phase may correspond to a first time period t1, the compensation phase may correspond to a second time period t2, the data writing phase may correspond to a third time period t3, and the light-emitting phase may correspond to a fourth time period t4. Here, the first time period may be less than the second time period, and the third time period may be less than the first time period, that is, the resetting phase may have duration less than that of the compensation phase and greater than that of the data writing phase.

As shown in FIGS. 2 and 3, in the resetting phase, that is, during the time period t1, the first control signal G2 is at a high level, and the second control signal Scan may be maintained at a high level within a preset time and may be maintained at a low level during other time periods, so that the first switching transistor T1 may be controlled to be continuously turned on, and the second switching transistor T2 may be controlled to be turned on for the preset time. Further, within the preset time, the reference voltage Vref is input at the data signal input terminal Data, so that a voltage at the control terminal of the driving transistor DrT may be controlled to be Vref, and a voltage at the first terminal of the driving transistor DrT may be controlled to be Vinitial+A, where A is a voltage drop generated due to current existing between the power supply terminal and the initial voltage input terminal.

As shown in FIGS. 2 and 4, in the compensation phase, that is, during the time period t2, the first control signal G2 is at a low level, and the second control signal Scan may be maintained at a high level within a preset time and may be maintained at a low level during other time periods, so that the first switching transistor T1 may be controlled to be turned off, and the second switching transistor T2 may be controlled to be turned on for the preset time. Here, the switching transistor indicated by broken lines in FIG. 4 is in a turn-off state, which applies below. Thereby, the voltage at the control terminal of the driving transistor DrT may be controlled to be Vref, and the voltage at the first terminal of the driving transistor DrT may be controlled to be Vref−Vth, where Vth is the threshold voltage of the driving transistor DrT. That is, a voltage difference across the compensation capacitor Cst is Vth, so that the threshold voltage Vth may be stored by the compensation capacitor Cst.

As shown in FIGS. 2 and 5, in the data writing phase, that is, during the time period t3, the first control signal G2 is at a low level, the second control signal Scan is at a high level, and a data voltage Vdata is input at the data signal input terminal Data, so that the first switching transistor T1 may be controlled to be turned off, and the second switching transistor T2 may be controlled to be turned on. Thereby, the voltage at the control terminal of the driving transistor DrT may be controlled to be Vdata, and the voltage at the first terminal of the driving transistor DrT may be controlled to be Vref−Vth+a(Vdata−Vref)+ΔV, where ΔV is a voltage difference generated by electric leakage of the driving transistor DrT in the data writing phase, and a is a ratio of voltages allocated to opposite terminals of the compensation capacitor Cst due to a capacitive voltage division effect in the data writing phase.

As shown in FIGS. 2 and 6, in the light-emitting phase, that is, during the time period t4, the first control signal G2 is at a low level, and the second control signal Scan is at a low level, so that the first switching transistor T1 and the second switching transistor T2 may both be controlled to be turned off. Thereby, the voltage Vgs=(1−a)(Vdata−Vref)+Vth−ΔV between the control terminal and the first terminal of the driving transistor DrT may be controlled. Current flowing through the OLED is $Ioled=\frac{1}{2}\times Ku(Vgs-Vth)^2=\frac{1}{2}\times Ku((1-a)(Vdata-Vref)-\Delta V)^2$, where Ku is a parameter related to a mobility of the driving transistor DrT. That is, Ioled is related to parameters such as Ku, Vdata, Vref, and ΔV etc., and is independent of the threshold voltage Vth of the driving transistor DrT.

According to the pixel compensation method according to the embodiments of the present disclosure, with the above-mentioned circuit structure using the two switching transistors T1, T2 and one compensation capacitor Cst in combination with control strategies for T1 and T2 in the resetting phase and the compensation phase, current of a pixel in the light-emitting phase is not affected by the threshold voltage Vth of the driving transistor DrT, and thus a change in Vth may be compensated. This compensation method not only enables a simple circuit structure, but also has high real-time performance for compensation, which can effectively improve the problem of display of residual images on the display panel and greatly improve the display effect of the display panel.

In order to further improve the compensation accuracy, the present disclosure further proposes a pixel compensation method by the display panel according to the embodiments of the present disclosure.

Figure 10:
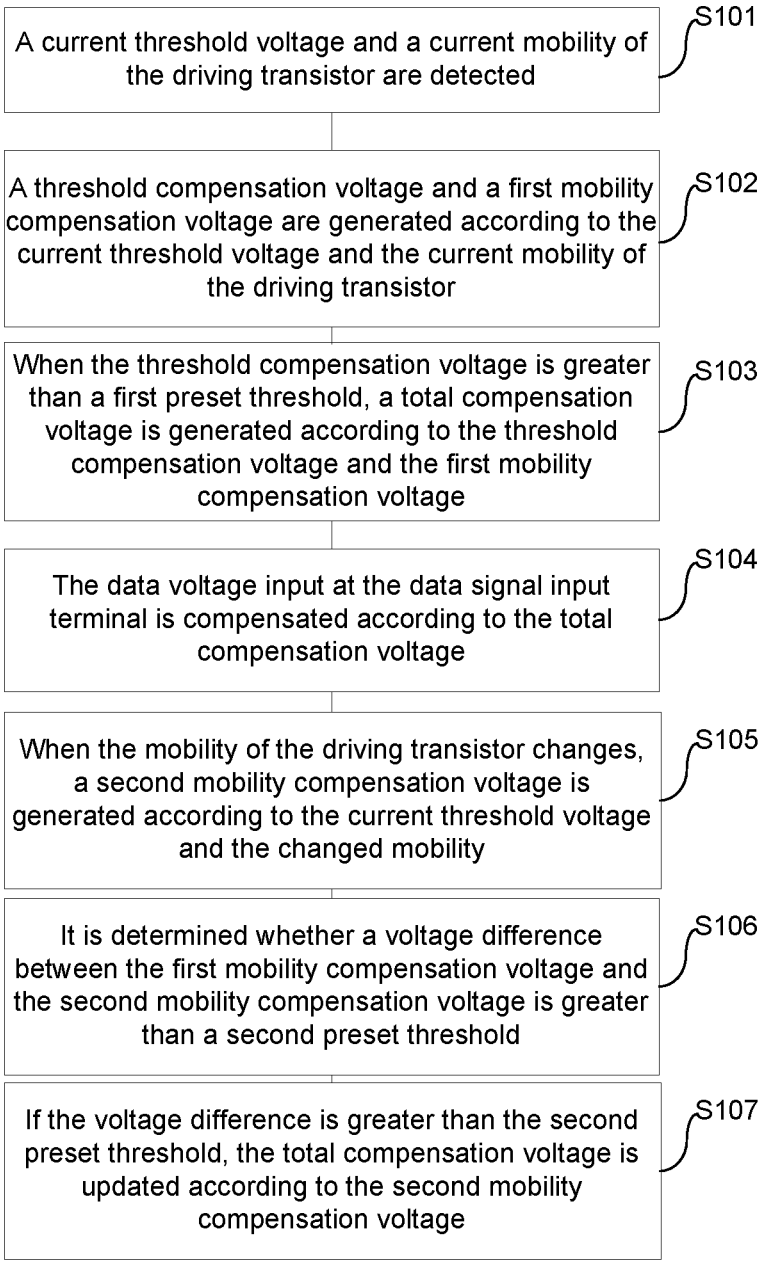
FIG. 10 is a flowchart of a pixel compensation method according to still another embodiment of the present disclosure.

As shown in FIG. 10, the method may comprise the following steps.

In S101, a current threshold voltage and a current mobility of the driving transistor are detected (through, for example, the first switching transistor).

In S102, a threshold compensation voltage and a first mobility compensation voltage are generated according to the current threshold voltage and the current mobility of the driving transistor.

The current threshold voltage Vth and the current mobility Mob of the driving transistor DrT are detected, and the threshold compensation voltage ΔVth and the first mobility compensation voltage ΔVmob are further calculated.

In S103, when the threshold compensation voltage is greater than a first preset threshold, a total compensation voltage is generated according to the threshold compensation voltage and the first mobility compensation voltage.

Here, the first preset threshold may be 0.5V. When ΔVth>0.5V, it is difficult to eliminate the influence of Vth on the current Ioled flowing through the OLED, and at this time, kΔVth may be added to the data voltage in the light-emitting phase.

In S104, the data voltage input at the data signal input terminal is compensated according to the total compensation voltage.

Specifically, the compensated data voltage is Vdata+kΔVth+ΔVmob, where k is a compensation coefficient, which may be acquired through subsequent adjustment and trial processes, and has a value ranging from 0 to 1.

In S105, when the mobility of the driving transistor changes, a second mobility compensation voltage is generated according to the current threshold voltage and the changed mobility.

Since the mobility of the driving transistor DrT is greatly affected by the temperature, when the mobility of the driving transistor DrT changes, for example, at a data black time, i.e., the time when the data is not written in each frame, the mobility compensation voltage may be acquired again to update the total compensation voltage, and the second mobility compensation voltage ΔVmob_new may be generated based on a previous threshold voltage of the driving transistor which is detected the last time.

In S106, it is determined whether a voltage difference between the first mobility compensation voltage and the second mobility compensation voltage is greater than a second preset threshold.

In S107, if the voltage difference is greater than the second preset threshold, the total compensation voltage is updated according to the second mobility compensation voltage.

That is, if the mobility compensation voltage changes greatly, the data voltage may be compensated using a mobility compensation voltage which is newly obtained. In one embodiment of the present disclosure, after mobilities of all rows of driving transistors DrT are acquired, the data voltage may be Vdata+kΔVth+ΔVmob_new in a light-emitting phase of a next frame.

After the pixel is powered off to stop emitting light, for example, after the OLED display panel stops emitting light due to shutdown, a power-off threshold voltage and a power-off mobility of the driving transistor DrT may be acquired and stored, so as to use the stored power-off threshold voltage and power-off mobility as an initial threshold voltage and an initial mobility respectively after the pixel is powered on again. Thereby, a strategy of compensating for the data voltage may be performed again according to the initial threshold voltage and the initial mobility when the display panel displays the next time.

In summary, the external compensation is combined with the internal compensation in the pixel driving circuit to achieve hybrid compensation, which can effectively improve the compensation accuracy, thereby further enhancing the display effect of the display panel.

In the description of the present disclosure, it is to be understood that orientation or positional relationships indicated by the terms "center", "longitudinal", "lateral", "length", "width", "thickness", "upper", "lower", "front", "rear", "left", "right", "vertical", "horizontal", "top", "bottom", "inside", "outside", "clockwise", "counterclockwise", "axial", "radial", "circumferential" etc. are based on the orientation or positional relationships shown in the accompanying drawings, and are merely for the convenience of describing the present disclosure and simplifying the description, but do not indicate or suggest that the indicated apparatus or element must have a particular orientation, or must be constructed and operated in a particular orientation, and therefore should not be construed as limiting the present disclosure.

Furthermore, the terms "first" and "second" are used for descriptive purposes only, and are not to be construed as indicating or implying relative importance or implicitly indicating a number of indicated technical features. Thus, features defined by "first" and "second" may explicitly or implicitly include at least one of the features. In the description of the present disclosure, "plurality" means at least two, such as two, three, etc., unless explicitly and specifically defined otherwise.

In the present disclosure, the terms "install," "electrically connect with," "connect to," "fix," etc. shall be understood in a broad sense unless specifically defined or stipulated otherwise. For example, they may be fixed connections, or detachable connections, or integral connections; or may be mechanical connections or electrical connections; or may be direct electrical connections, or indirect electrical connections through an intermediary; or may be internal connections between two elements or interactions between two elements, unless explicitly defined otherwise. Those of ordinary skill in the art can understand the specific meanings of the above terms in the present disclosure according to specific conditions.

In the present disclosure, unless specifically stipulated and defined otherwise, the first feature "above" or "below" the second feature may be that the first feature and the second feature are in direct contact, or that the first feature and the second feature are in indirect contact via an intermediary. Further, the first feature "above", "on" and "on top of" the second feature may be that the first feature is directly above or diagonally above the second feature, or may simply indicate that the first feature is higher than the second feature in height. The first feature "under", "below" and "beneath" the second feature may be that the first feature is directly below or diagonally below the second feature, or may simply indicate that the first feature is lower than the second feature.

In the description of the present specification, the description referring to the terms "one embodiment", "some embodiments", "an example", "a specific example", or "some examples" etc. means that a specific feature, structure, material or characteristics described in conjunction with the embodiment or example is included in at least one embodiment or example of the present disclosure. In the present specification, schematic expressions of the above terms do not necessarily have to refer to the same embodiment or example. Furthermore, the specific feature, structure, material, or characteristics described may be combined in any suitable manner in any one or more embodiments or examples. In addition, those skilled in the art can combine and merge different embodiments or examples described in the present specification and features in different embodiments or examples without conflicting with each other.

Although the embodiments of the present disclosure have been shown and described above, it can be understood that the above embodiments are exemplary and are not to be construed as limiting the present disclosure. Those of ordinary skill in the art can make changes, modifications, substitutions and variations to the above embodiments within the scope of the present disclosure.

We claim:

1. A pixel driving circuit, comprising a driving sub-circuit, a compensation sub-circuit, a first switching sub-circuit, and a second switching sub-circuit, wherein the driving sub-circuit has a control terminal electrically connected to a first terminal of the second switching sub-circuit, a first terminal electrically connected to a light-emitting element, and a second terminal electrically connected to a power source;

the compensation sub-circuit has a first terminal electrically connected to the first terminal of the driving sub-circuit, and a second terminal electrically connected to the control terminal of the driving sub-circuit;

the first switching sub-circuit has a control terminal electrically connected to a first signal input terminal, a first terminal electrically connected to the first terminal of the driving sub-circuit, and a second terminal electrically connected to an initial voltage input terminal; and the second switching sub-circuit has a control terminal electrically connected to a second signal input terminal, a first terminal electrically connected to the control terminal of the driving sub-circuit, and a second terminal electrically connected to a data signal input terminal, wherein the second switching, sub-circuit is configured to receive a compensated data voltage from the data signal input terminal, wherein the compensated data voltage is determined based on a threshold voltage and a mobility of the driving sub-circuit.

2. The pixel driving circuit according to claim 1, wherein in a resetting phase, the first switching sub-circuit is configured to be in a turn-on state under control of the first signal input terminal, and the second switching sub-circuit is configured to be in a turn-on state within a preset time under control of the second signal input terminal; and in a compensation phase, the first switching sub-circuit is configured to be in a turn-off state under control of the first signal input terminal, and the second switching sub-circuit is configured to be in a turn-on state within the preset time under control of the second signal input terminal.

3. The pixel driving circuit according to claim 2, wherein in a data writing phase, the first switching sub-circuit is configured to be in a turn-off state under control of the first signal input terminal, and the second switching sub-circuit is configured to be in a turn-on state under control of the second signal input terminal; and in a light-emitting phase, the first switching sub-circuit is configured to be in a turn-off state under control of the first signal input terminal, and the second switching sub-circuit is configured to be in a turn-off state under control of the second signal input terminal.

4. The pixel driving circuit according to claim 3, wherein a duration of the resetting phase is less than that of the compensation phase, and a duration of the data writing phase is less than that of the resetting phase.

5. A display panel, comprising the pixel driving circuit according to claim 1.

6. The display panel according to claim 5, further comprising: a controller configured to:

detect a current threshold voltage and a current mobility of the driving sub-circuit;

generate a threshold compensation voltage and a first mobility compensation voltage according to the current threshold voltage and the current mobility of the driving sub-circuit;

generate a total compensation voltage according to the threshold compensation voltage and the first mobility compensation voltage when the threshold compensation voltage is greater than a first preset threshold; and compensate for a data voltage input to the pixel driving circuit according to the total compensation voltage.

7. The display panel according to claim 6, wherein the controller is further configured to: when the mobility of the driving sub-circuit changes, generate a second mobility compensation voltage according to the current threshold voltage and the changed mobility, and update the total compensation voltage according to the second mobility compensation voltage when a voltage difference between the first mobility compensation voltage and the second mobility compensation voltage is greater than a second preset threshold.

8. The display panel according to claim 7, wherein the controller is further configured to: acquire a power-off threshold voltage and a power-off mobility of the driving sub-circuit when a pixel is powered off to stop emitting light, and store the power-off threshold voltage and the power-off mobility through a memory, so that the power-off threshold voltage and the power-off mobility stored in the memory are used as an initial threshold voltage and an initial mobility respectively after the pixel is powered on again.

9. A method for driving the pixel driving circuit according to claim 1, comprising:

in a resetting phase, controlling the first switching sub-circuit to be turned on, and controlling the second switching sub-circuit to be turned on for a preset time; and in a compensation phase, controlling the first switching sub-circuit to be turned off, and controlling the second switching sub-circuit to be turned on for the preset time.

10. The method according to claim 9, further comprising:

in a data writing phase, controlling the first switching sub-circuit to be turned off, and controlling the second switching sub-circuit to be turned on; and in a light-emitting phase, controlling the first switching sub-circuit and the second switching sub-circuit to be turned off.

11. The method according to claim 10, wherein a duration of the resetting phase is less than that of the compensation phase, and a duration of the data writing phase is less than that of the resetting phase.

12. A method by the display panel according to claim 5, comprising:

detecting a current threshold voltage and a current mobility of the driving sub-circuit;

generating a threshold compensation voltage and a first mobility compensation voltage according to the current threshold voltage and the current mobility of the driving sub-circuit; and generating a total compensation voltage according to the threshold compensation voltage and the first mobility compensation voltage when the threshold compensation voltage is greater than a first preset threshold; and compensating for a data voltage input at the data signal input terminal according to the total compensation voltage.

13. The method according to claim 12, further comprising:

when the mobility of the driving sub-circuit changes, generating a second mobility compensation voltage according to the current threshold voltage and the changed mobility;

determining whether a voltage difference between the first mobility compensation voltage and the second mobility compensation voltage is greater than a second preset threshold; and if the voltage difference is greater than the second preset threshold, updating the total compensation voltage according to the second mobility compensation voltage.

14. The method according to claim 13, further comprising:

acquiring a power-off threshold voltage and a power-off mobility of the driving sub-circuit when the pixel is powered off to stop emitting light, and storing the power-off threshold voltage and the power-off mobility, so that the stored power-off threshold voltage and power-off mobility are used as an initial threshold voltage and an initial mobility respectively after the pixel is powered on again.

15. The pixel driving circuit according to claim 1, wherein the driving sub-circuit comprises a driving transistor, the compensation sub-circuit comprises a compensation capacitor, the first switching sub-circuit comprises a first switching transistor, and the second switching sub-circuit comprises a second switching transistor, wherein the driving transistor has a gate connected to the control terminal of the driving sub-circuit, a source connected to one of the first terminal and the second terminal of the driving sub-circuit, and a drain connected to the other of the first terminal and the second terminal of the driving sub-circuit, the compensation capacitor has one terminal connected to one of the first terminal and the second terminal of the compensation sub-circuit, and the other terminal connected to the other of the first terminal and the second terminal of the compensation sub-circuit, the first switching transistor has a gate connected to the control terminal of the first switching transistor sub-circuit, a source connected to one of the first terminal and the second terminal of the first switching transistor sub-circuit, and a drain connected to the other of the first terminal and the second terminal of the first switching transistor sub-circuit, and the second switching transistor has a gate connected to the control terminal of the second switching sub-circuit, a source connected to one of the first terminal and the second terminal of the second switching sub-circuit, and a drain connected to the other of the first terminal and the second terminal of the second switching sub-circuit.

16. A display panel, comprising the pixel driving circuit according to claim 4.

17. The display panel according to claim 16, further comprising: a controller configured to:

detect a current threshold voltage and a current mobility of the driving sub-circuit;

generate a threshold compensation voltage and a first mobility compensation voltage according to the current threshold voltage and the current mobility of the driving sub-circuit;

generate a total compensation voltage according to the threshold compensation voltage and the first mobility compensation voltage when the threshold compensation voltage is greater than a first preset threshold; and compensate for a data voltage input to the pixel driving circuit according to the total compensation voltage.

18. A method by the display panel according to claim 16, comprising:

detecting a current threshold voltage and a current mobility of the driving sub-circuit;

generating a threshold compensation voltage and a first mobility compensation voltage according to the current threshold voltage and the current mobility of the driving sub-circuit; and generating a total compensation voltage according to the threshold compensation voltage and the first mobility compensation voltage when the threshold compensation voltage is greater than a first preset threshold; and compensating for a data voltage input at the data signal input terminal according to the total compensation voltage.

19. The method according to claim 18, further comprising:

when the mobility of the driving sub-circuit changes, generating a second mobility compensation voltage according to the current threshold voltage and the changed mobility;

determining whether a voltage difference between the first mobility compensation voltage and the second mobility compensation voltage is greater than a second preset threshold; and if the voltage difference is greater than the second preset threshold, updating the total compensation voltage according to the second mobility compensation voltage.

20. The method according to claim 19, further comprising:

acquiring a power-off threshold voltage and a power-off mobility of the driving sub-circuit when the pixel is powered off to stop emitting light, and storing the power-off threshold voltage and the power-off mobility, so that the stored power-off threshold voltage and power-off mobility are used as an initial threshold voltage and an initial mobility respectively after the pixel is powered on again.

* * * * *